US007159335B2

(12) United States Patent
Chen

(10) Patent No.: US 7,159,335 B2
(45) Date of Patent: Jan. 9, 2007

(54) SHOE HAVING AN UPPER MADE OF A WATERPROOF BREATHABLE LAMINATE

(75) Inventor: Eddie Chen, 9F, No. 201, Sec. 1, Taichung-Kang Rd., Taichung City (TW)

(73) Assignee: Eddie Chen (TW)

( * ) Notice: Subject to any disclaimer, the term of this patent is extended or adjusted under 35 U.S.C. 154(b) by 247 days.

(21) Appl. No.: 10/812,627

(22) Filed: Mar. 29, 2004

(65) Prior Publication Data

US 2005/0210708 A1 Sep. 29, 2005

(51) Int. Cl.
*A43B 23/07* (2006.01)

(52) U.S. Cl. ..... 36/4; 36/12; 36/14; 36/10; 36/55

(58) Field of Classification Search ..... 36/4, 36/12, 14, 10, 55, 21, 43, 44, 17 R, 17 PW
See application file for complete search history.

(56) References Cited

U.S. PATENT DOCUMENTS 4,122,574 A * 10/1978 Karalis ..... 12/142 RS
5,285,546 A * 2/1994 Haimerl ..... 12/142 E
5,433,021 A * 7/1995 Mahler ..... 36/12
5,505,011 A * 4/1996 Bleimhofer ..... 36/4
5,918,382 A * 7/1999 Haderlein et al. ..... 36/14
6,088,935 A * 7/2000 Pavelescu et al. ..... 36/14
6,604,302 B1 * 8/2003 Polegato Moretti ..... 36/55
6,820,352 B1 * 11/2004 Keidel et al. ..... 36/12
6,851,205 B1 * 2/2005 Chen et al. ..... 36/55
6,928,755 B1 * 8/2005 Chen et al. ..... 36/12
2003/0041474 A1 * 3/2003 Keidel et al. ..... 36/12
2005/0055843 A1 * 3/2005 Morlacchi ..... 36/17 R

* cited by examiner

*Primary Examiner*—Marie Patterson
(74) *Attorney, Agent, or Firm*—DLA Piper US LLP

(57) ABSTRACT

A shoe includes an upper made of a waterproof breathable laminate which is composed of at least one outer layer having an inner surface and an outer surface, and a waterproof vapor-permeable membrane laminated to the inner surface of the outer layer; and an inner sole which includes a bottom plate and an inner sidewall extending upwardly from a periphery of the bottom plate. The inner sidewall is connected to a bottom end of the upper. The bottom end of the upper ends at a level not lower than the bottom plate.

12 Claims, 11 Drawing Sheets

SHOE HAVING AN UPPER MADE OF A WATERPROOF BREATHABLE LAMINATE

BACKGROUND OF THE INVENTION

1. Field of the Invention

This invention relates to a shoe, more particularly to a shoe having an upper made of a waterproof breathable laminate.

2. Description of the Related Art

Conventional waterproof shoes are generally made by sewing a liner made of a waterproof breathable material and an additional inner liner to an upper. In such shoes, the upper and the two liners are separate pieces which are assembled together through a sewing process. The resultant assembly is then subjected to waterproof treatment in order to ensure water-tightness at the seams of the assembly. A last is then put inside the inner liner in order to assemble an inner sole to the upper and the two liners through a lasting process or a Strobel stitching process and to further attach an outsole thereto. Examples of such waterproof shoes are disclosed in U.S. Pat. Nos. 4,599,810, 5,426,869, 5,628,127, 5,746,012, 5,918,382, and 5,930,917.

The aforesaid methods of making shoes are laborious and time-consuming. In addition, since the waterproof breathable liner is typically formed into a sock-like structure, as shown in FIG. 1, a rather large amount of the waterproof breathable material is needed to make such a liner. Furthermore, as the seams resulting from the sewing of the waterproof breathable material into the sock-like structure have to be sealed or taped for watertightness, the production cost thereof is increased.

The prior art also suggests a waterproof breathable liner which has a sock-like configuration but is open at a bottom thereof. The open bottom end of such a liner is usually connected to an inner sole by a cementing process. FIG. 2 shows a waterproof shoe 1 having a waterproof breathable liner 2 with an open bottom cemented to an inner sole 3 of the shoe. To ensure waterproofness and durability, the material of the liner 2 at the bottom end thereof extends a considerable length to the inner side of the inner sole 3 and is then folded to form a hollow region which is then filled with a waterproof material. Although the amount of the waterproof breathable material used in this liner is reduced as compared to the sock-like liner, the reduction in the material used therein is limited.

Practically, for effective waterproofness, a waterproof shoe is made in such a manner that it has a midsole or outsole to surround the bottom and the lateral side of the toe portion of the wearer's foot. Thus, ventilation of the shoe is usually insufficient for the toe portion of the foot, even if the shoe is provided with a waterproof breathable material. In view of this, it is apparent that, despite use of the waterproof breathable liner, the prior art shown in FIG. 2 would be unable to ventilate the toe part of the shoe and that the waterproof breathable material provided at the toe part of the shoe has been extravagantly used.

SUMMARY OF THE INVENTION

An object of the present invention is to provide a waterproof breathable shoe which can be fabricated at a reduced cost by minimizing the amount of waterproof breathable material used for the shoe and by effectively utilizing the material.

Another object of the present invention is to provide a waterproof breathable shoe which can be fabricated with a simplified process using a waterproof breathable laminate as the material for an upper.

According to the present invention, a waterproof breathable shoe comprises an upper made of a waterproof breathable laminate which includes at least one outer layer having an inner surface and an outer surface, and a waterproof vapor-permeable membrane laminated to the inner surface of the outer layer; and an inner sole which includes a bottom plate and an inner sidewall extending upwardly from a periphery of the bottom plate, the inner sidewall being connected to a bottom end of the upper, the bottom end of the upper ending at a level not lower than the bottom plate.

Alternatively, the waterproof breathable laminate may further include a lining layer laminated to an inner surface of the waterproof vapor-permeable membrane. Furthermore, the waterproof breathable laminate may additionally include a thermal insulation layer between the waterproof vapor-permeable membrane, and the lining layer.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
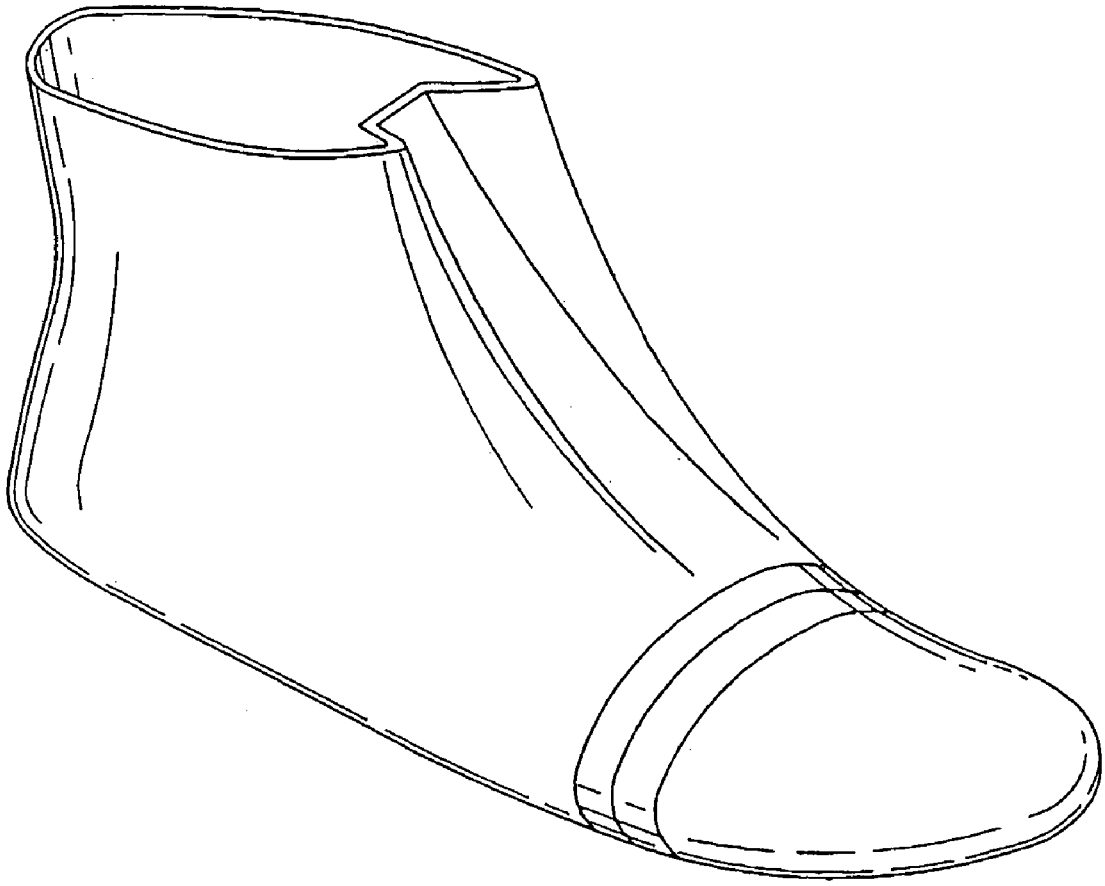
FIG. 1 PRIOR ART
FIG. 1 shows a sock-like liner in the prior art.
Figure 2:
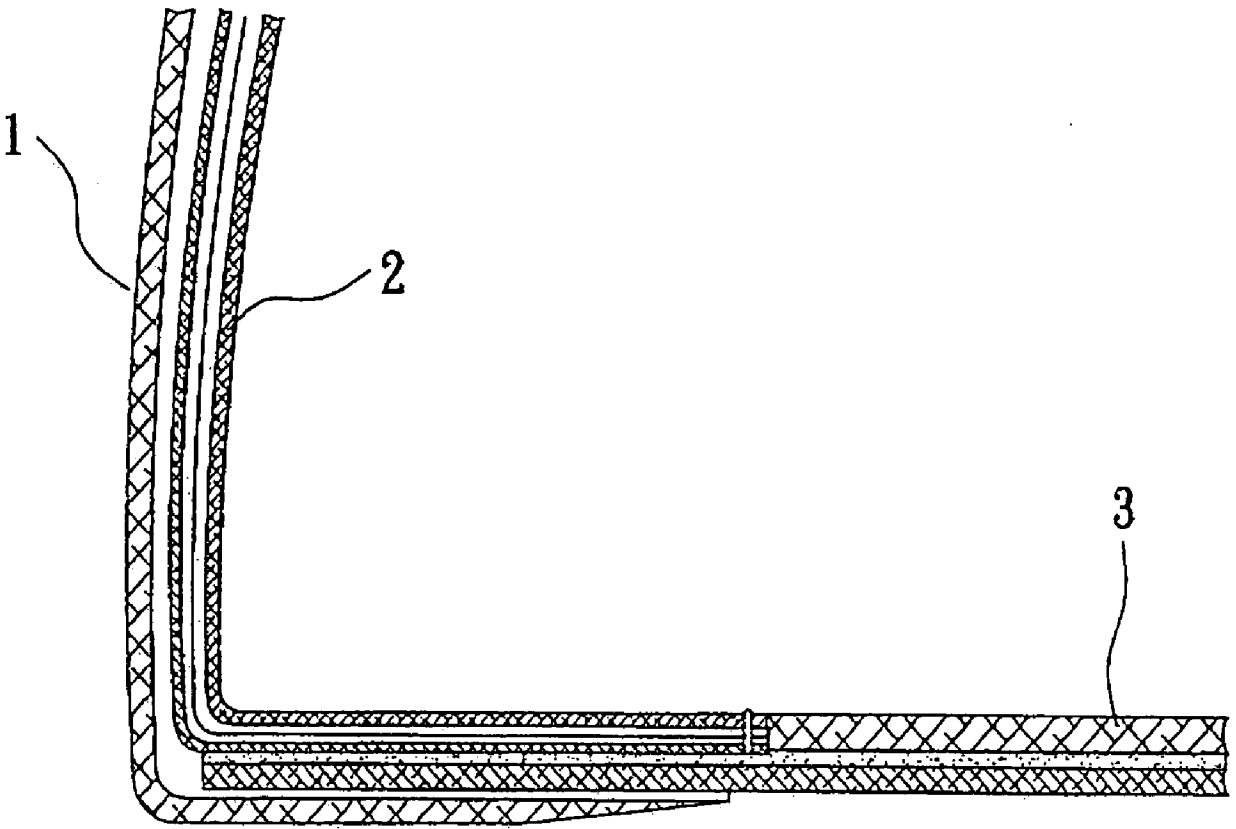
FIG. 2 PRIOR ART
FIG. 2 shows a conventional shoe construction incorporating a waterproof breathable liner.

Before the present invention is described in greater detail, it should be noted that same reference numerals have been used to denote like elements throughout the specification.

Figure 3:
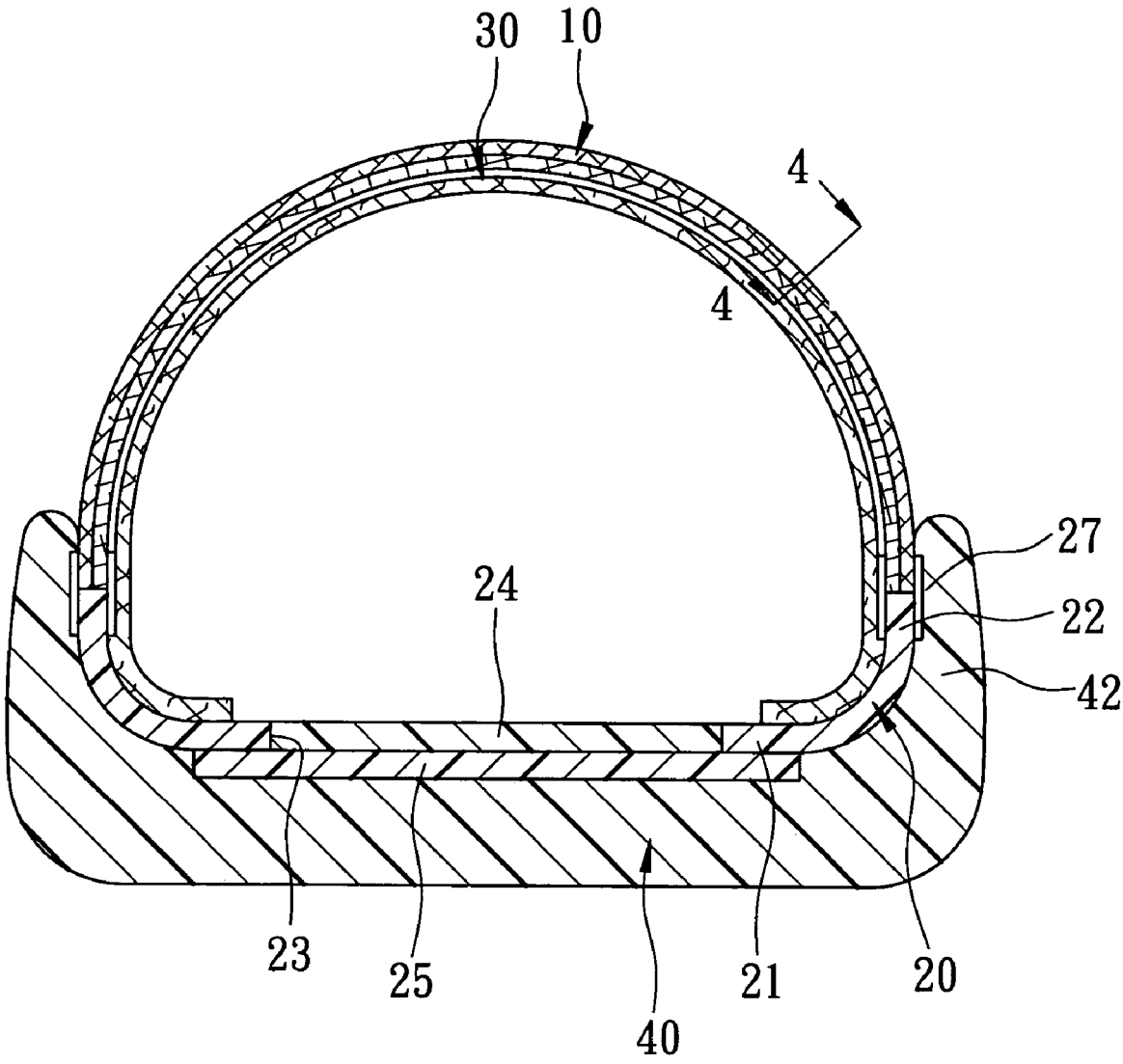
FIG. 3 is a sectional view of the first preferred embodiment of a shoe according to this invention.
Figure 4:
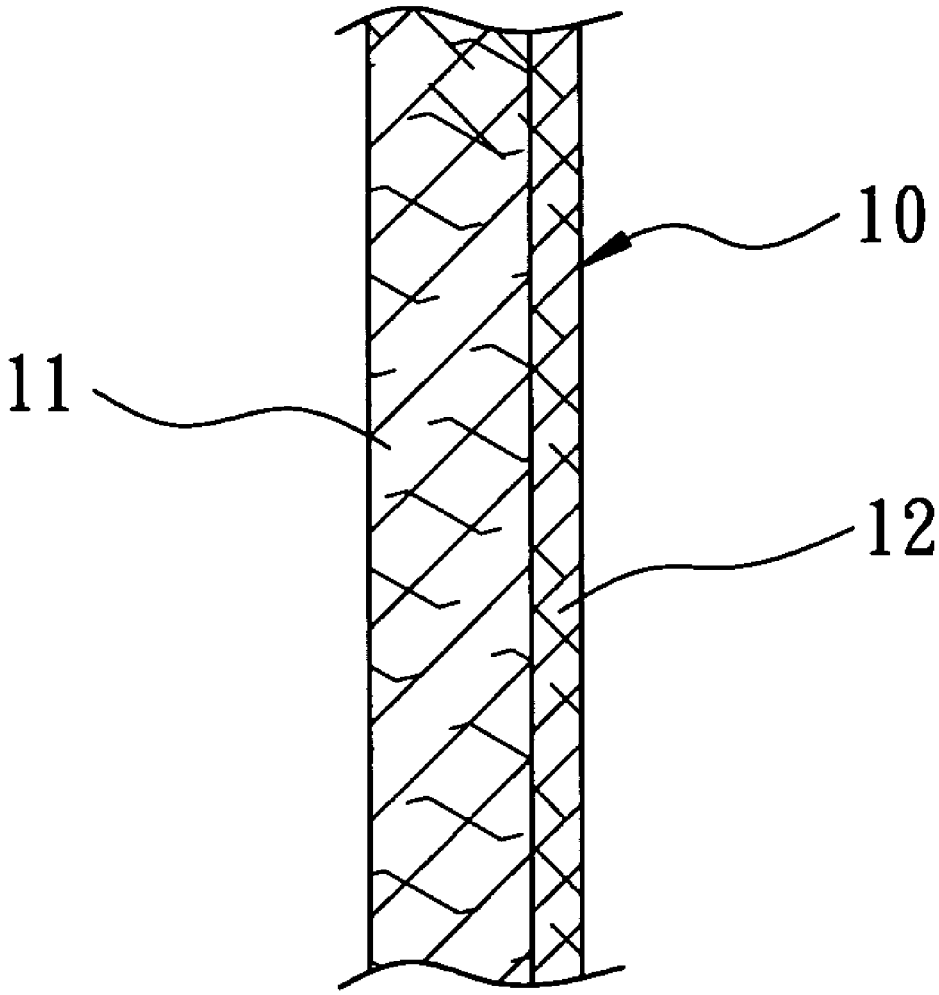
FIG. 4 is a section view taken along line 4—4 of FIG. 3.

Referring to FIGS. 3 and 4, a first preferred embodiment of the waterproof breathable shoe according to the present invention is shown to include a laminated upper 10, a three-dimensional inner sole or insole 20, a lining 30 and an outer sole or outsole 40.

The upper 10 is made of a waterproof breathable laminate which is composed of two or more layers. In this embodiment, the waterproof breathable laminate of the upper 10 includes a protective outer layer 11 and a waterproof vapor-permeable layer 12 as best shown in FIG. 4. The outer layer 11 may be any fabric or plastic sheet material, which is porous, rugged, and abrasion resistant. The waterproof vapor-permeable membrane 12 may be any commercially available membrane which is waterproof and vapor permeable, such as the membrane known under the trademark "GORE-TEX" or "SYMPATEX." A commercially available waterproof breathable laminate is manufactured by W.L. GORE & ASSOCIATES, INC., using the membrane known by the trade name "GORE-TEX." In this embodiment, the upper 10 is a two-layered laminate which includes an outer layer 11 and a waterproof vapor-permeable membrane 12. The upper 10 is fabricated by tailoring and sewing the waterproof breathable laminate.

The inner sole 20 functions as a sole pad and may be made of a thermoplastic material, a foam material or a composite material. Preferably, the inner sole 20 is made of a waterproof material. The inner sole 20 includes a bottom plate 21 and an inner sidewall 22 extending upwardly from a periphery of the bottom plate 21. The inner sidewall 22 of the inner sole 20 is connected to a bottom open end of the upper 10 through a conventional connecting method, such as by adhesive bonding or sewing. The bottom open end of the upper 10 substantially ends at a level not lower than the bottom plate 21 of the inner sole 20. The inner sole 20 is fabricated by a molding process and may be a one-piece molded body or include at least two individual pieces. Preferably, the inner sole 20 is made of a water proof material. The inner sole 20 may also be made of non-waterproof material since the bottom plate 21 and the inner sidewall of the inner sole 20 are surrounded by the outer sole 40 which can prevent water from invading the shoe through the inner sole 20.

The inner sidewall 22 of the inner sole 20 may be provided with a constant height along the full length thereof, or a height which varies along the length thereof. For instance, since a shoe is generally not ventilated at a rear portion where a counter is provided, the inner sidewall 22 at the rear region of the inner sole 20 may have a height as high as the counter so that the waterproof breathable laminate can be used economically. In addition, the inner insole 20 may be provided with different degrees of softness and rigidity at different parts thereof to contribute to the comfortability and durability of the shoe.

Figure 4A:
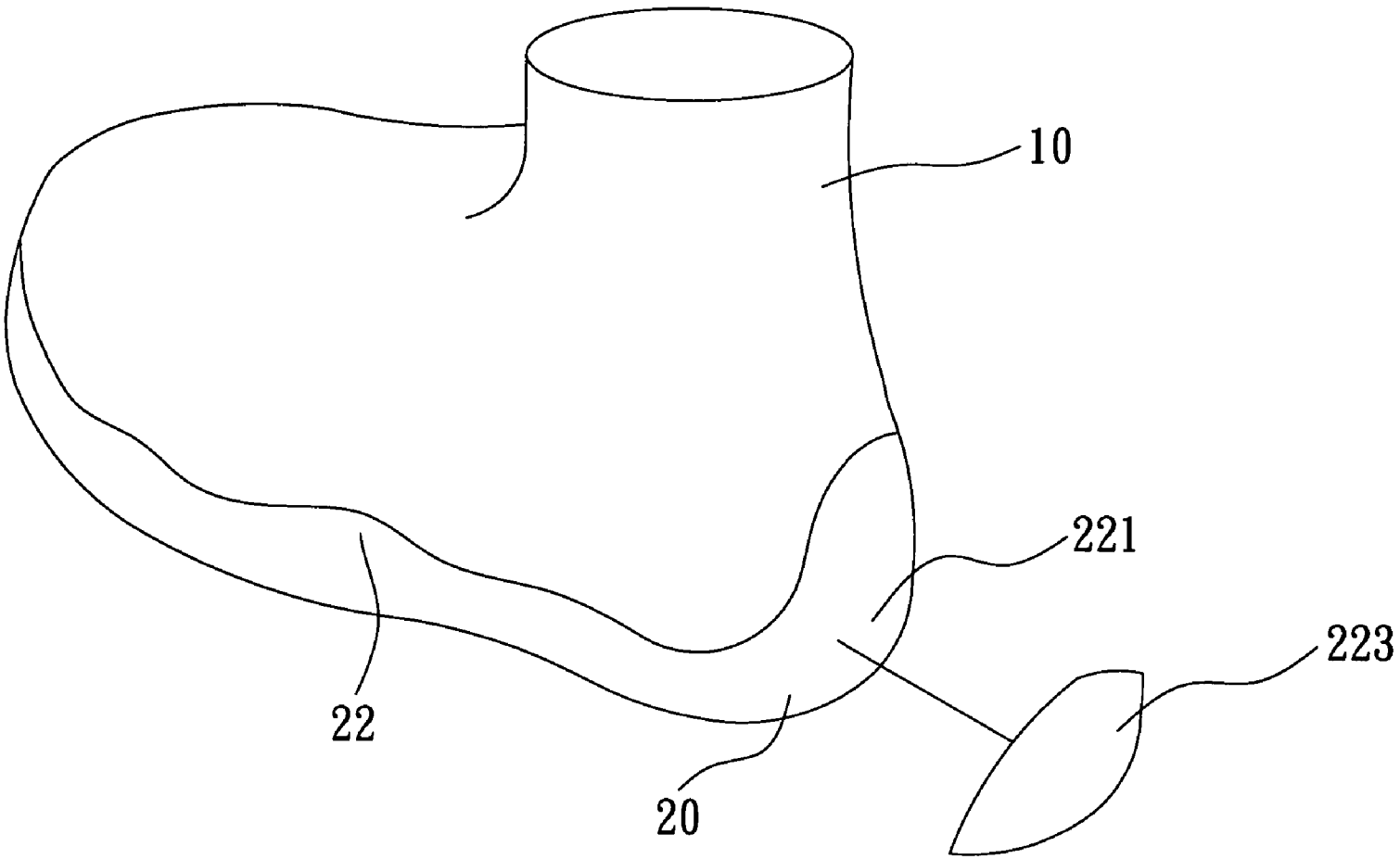
FIG. 4A is a schematic side view showing an assembly of an upper and an inner sole of the first embodiment.
Figure 4B:
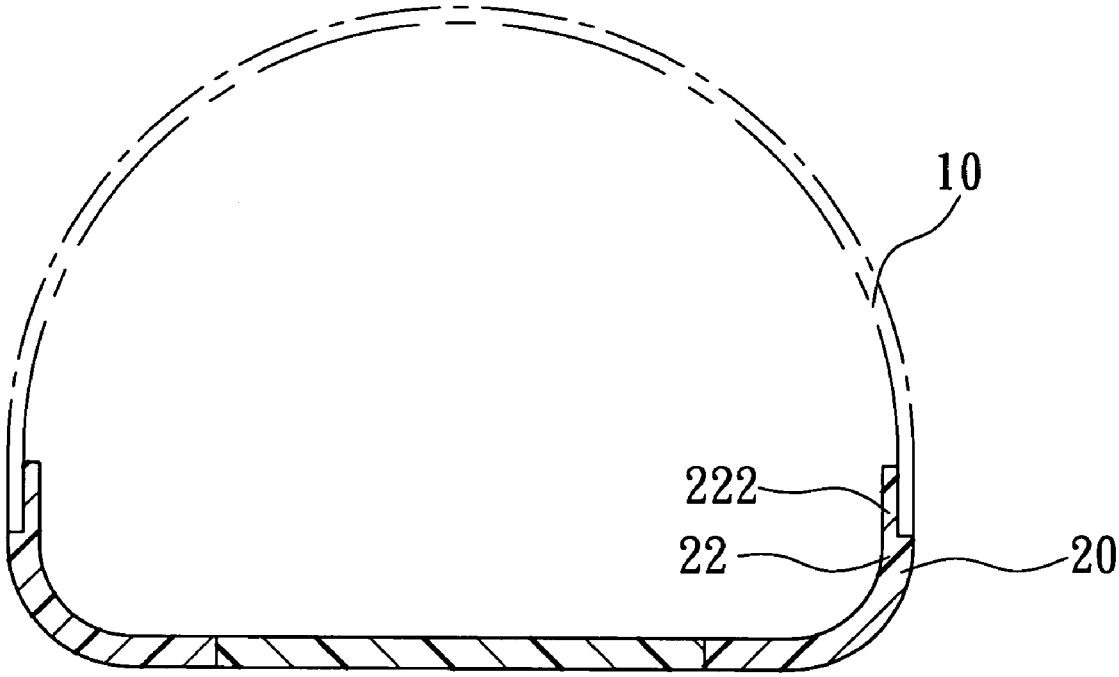
FIG. 4B is a schematic sectional view of the inner sole of the first embodiment.

As shown in FIG. 4A, the inner sidewall 22 of the inner sole 20 has a rear portion 221 which is higher than the remaining portion of the inner side wall 22 so that the dimensions of the upper 10 is reduced at the rear portion of the upper 10 and the amount of the waterproof breathable laminate needed to make the upper 10 can be reduced. If the inner sole 22 is made of a soft material, a reinforcement piece or counter piece 223 may be attached to the rear portion of the inner side wall 22 of the inner sole 20 in order to strengthen or prevent deformation of the inner side wall 22. On the other hand, the inner side wall 22 may be formed with a stepped configuration 222, as shown in FIG. 4B, so as to facilitate attachment of the inner sole 20 to the bottom end of the upper 10.

A waterproof tape 27 is used to seal the connection formed between the inner sidewall 22 of the inner sole 20 and the bottom open end of the upper 10. The lining 30 is disposed inside and connected to the upper 10 before the inner sole 20 is attached to the upper 10. The bottom end of the lining 30 extends to the bottom plate 21 of the inner sole 20 and is connected to the bottom plate 21. The bottom plate 21 is provided with an opening 23 to facilitate the taping of the connection between the inner sidewall 22 and the upper 10. A filler 24 is used to fill the opening 23. A sole plate 25 is attached to the bottom plate 21. The resulting seams between the sole plate 25 and the bottom plate 21 may be taped if necessary.

The outer sole 40 is cemented to the bottom of the bottom plate 21 of the inner sole 20 and has an outer sidewall 42 covering the inner sidewall 22 and the bottom end of the upper 10.

Figure 5:
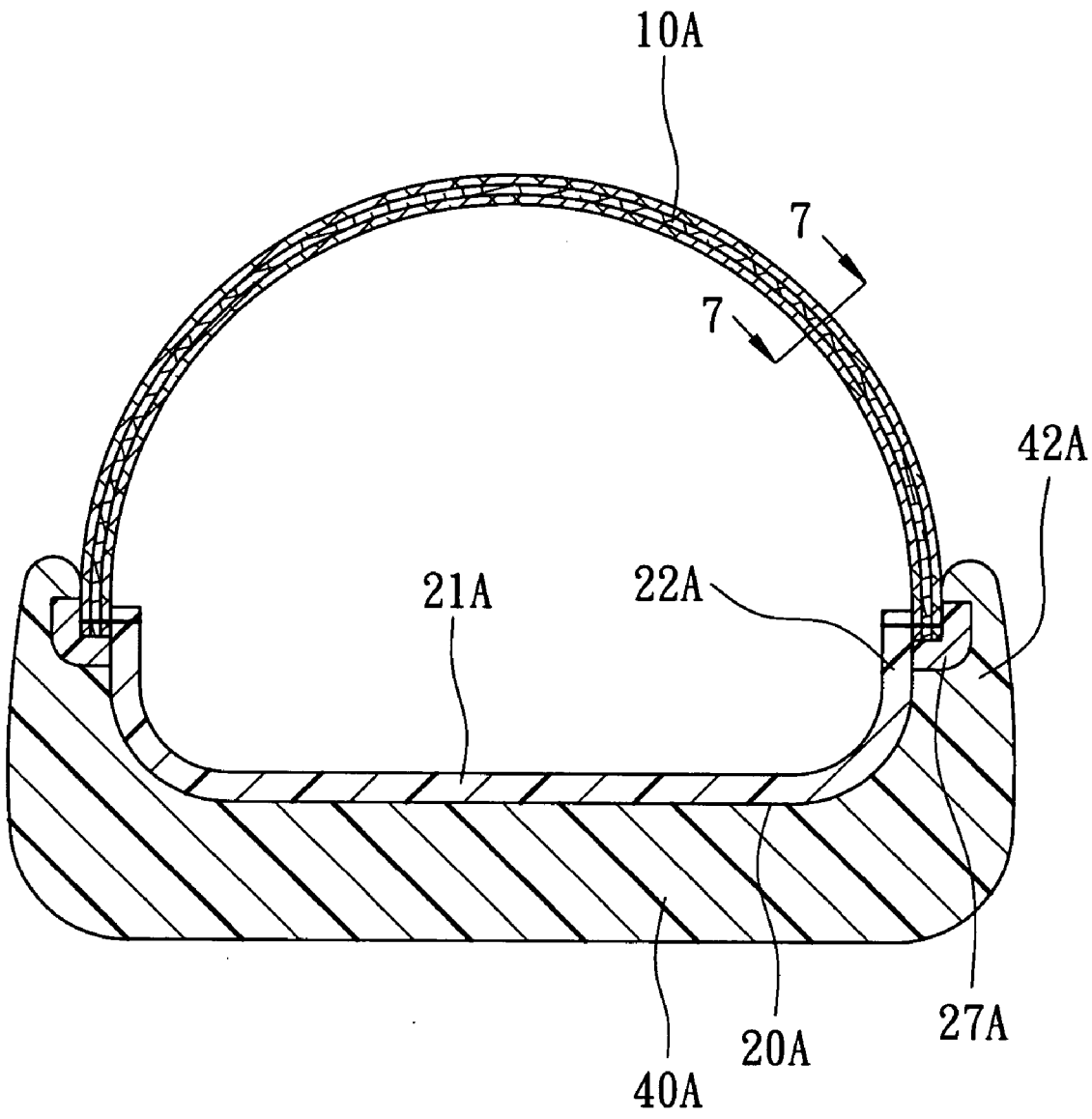
FIG. 5 is a sectional view of the second preferred embodiment of a shoe according to the present invention.
Figure 6:
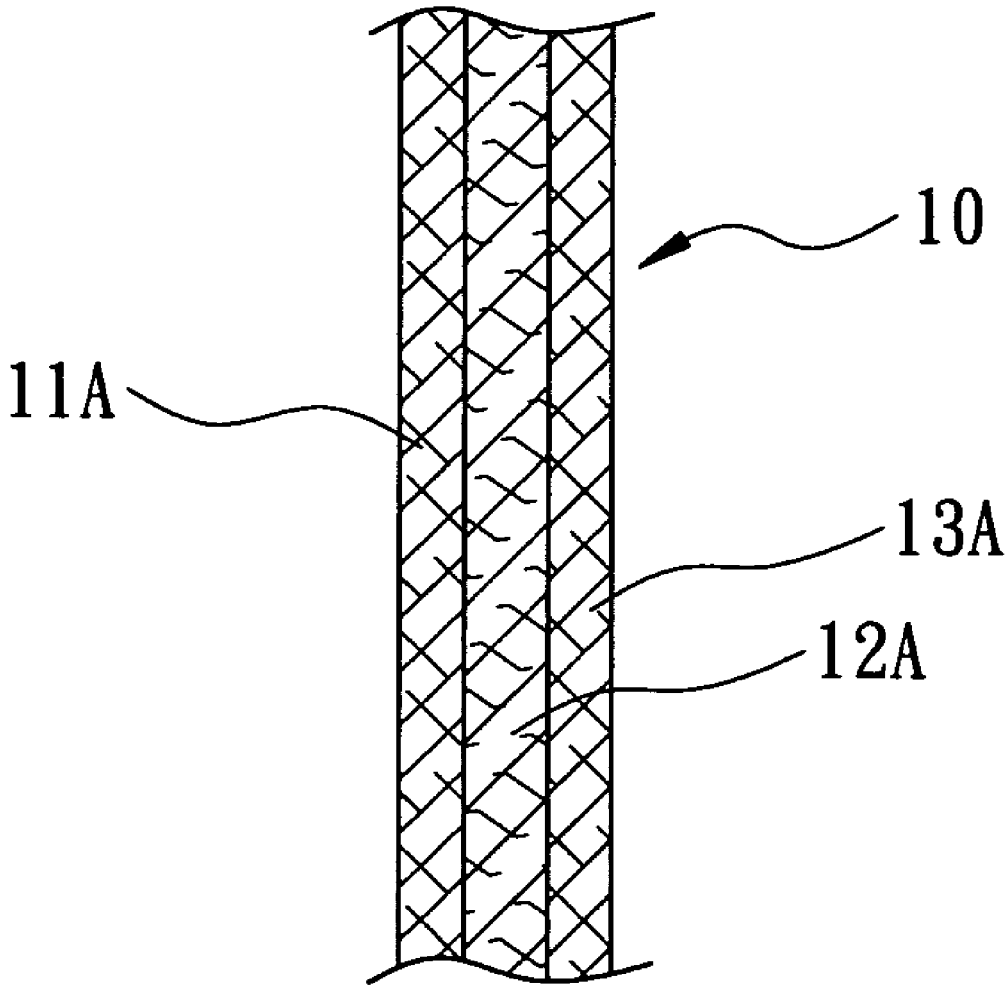
FIG. 6 is a sectional view taken along line 7—7 of FIG. 4.

Referring to FIGS. 5 and 6, the second preferred embodiment of the present invention is shown to include a laminated upper 10A sewn to an inner sidewall 22A of an inner sole 20A. The upper 10A is made of a three-layered laminate which is composed of an outer layer 11A, a waterproof vapor-permeable membrane 12A and a lining layer 13A. A waterproof tape 27A is used to seal the seam between the inner sidewall 22A and the upper 10A. Alternatively, the upper 10A may be cemented to the innersole 20A. Furthermore, in order to improve the appearance of the upper 10A, an inner lining (not shown) may be disposed within the laminated upper 10A. An outsole 40A is cemented to the bottom plate 21A of the inner sole 20A and has an outer sidewall 42A covering the inner sidewall 22A and the bottom end of the upper 10A.

Figure 7:
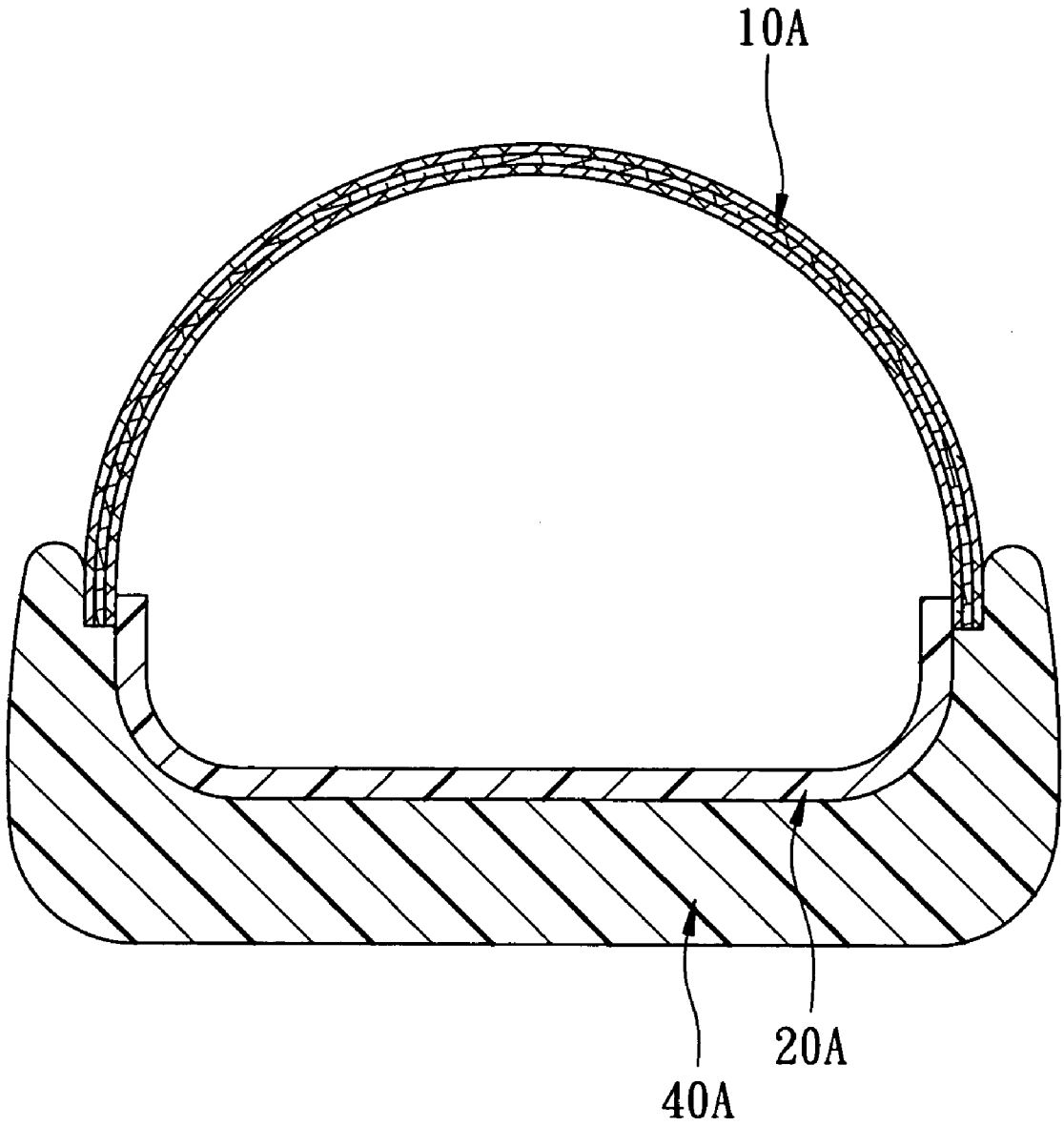
FIG. 7 is a sectional view of the third preferred embodiment of the present invention.

Referring to FIG. 7, a third preferred embodiment of the present invention is substantially similar to the second embodiment except that the upper 10A is connected to the inner sole 20A through a thermal welding process or a thermal cementing process which provides a strong connection between the inner sole 20A and an upper 10A. The outsole 40A in this embodiment is formed by placing a last into the upper 10A and by molding the outsole 40A over the inner sole 20A and over the bottom end of the upper 10A using a mold. As such, the taping of the connection between the upper 10A and the inner sole 20A is not needed since the connection between the upper 10A and the inner sole 20A is well protected and waterproofed by the outsole 40A.

Figure 8:
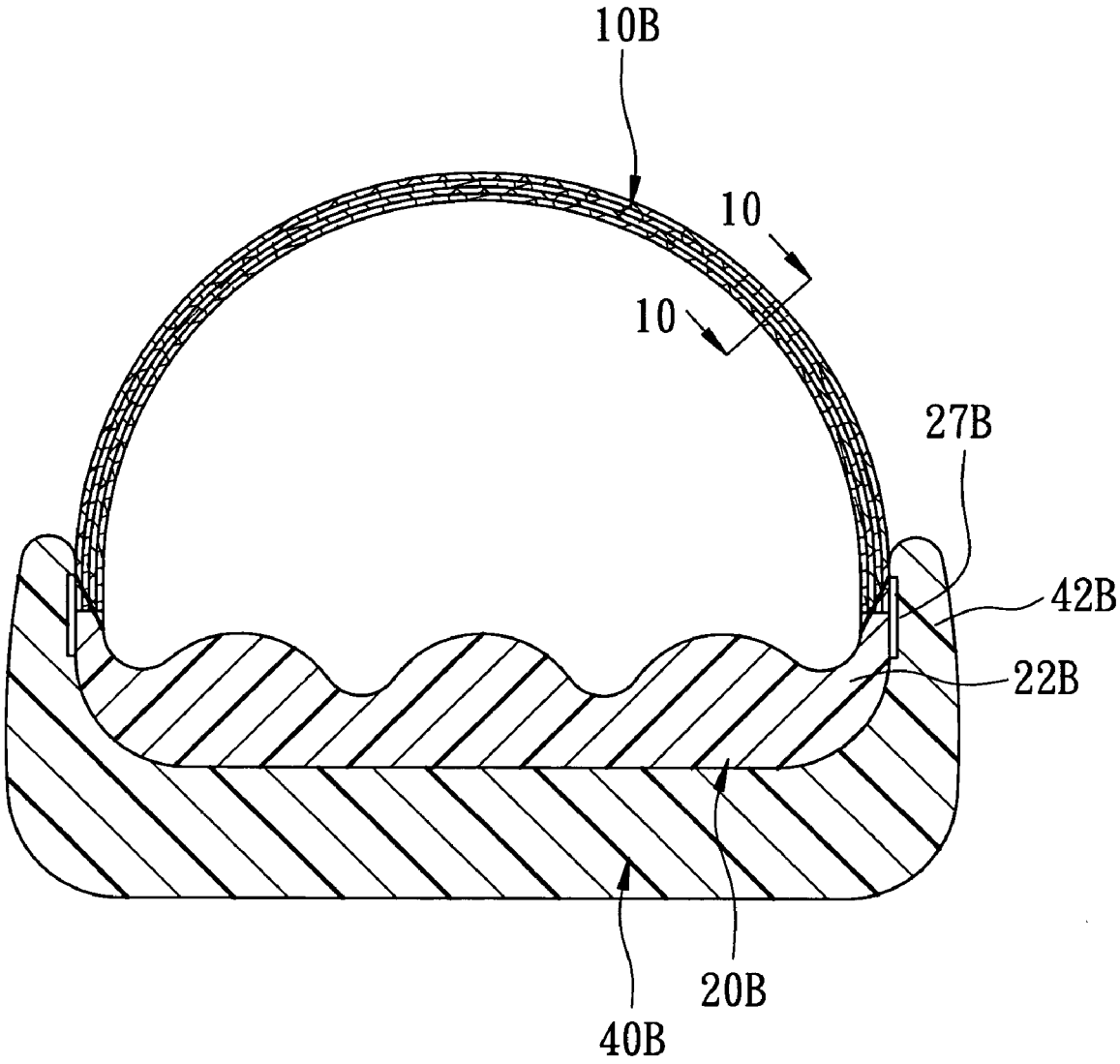
FIG. 8 is a sectional view of the fourth preferred embodiment of the present invention.
Figure 9:
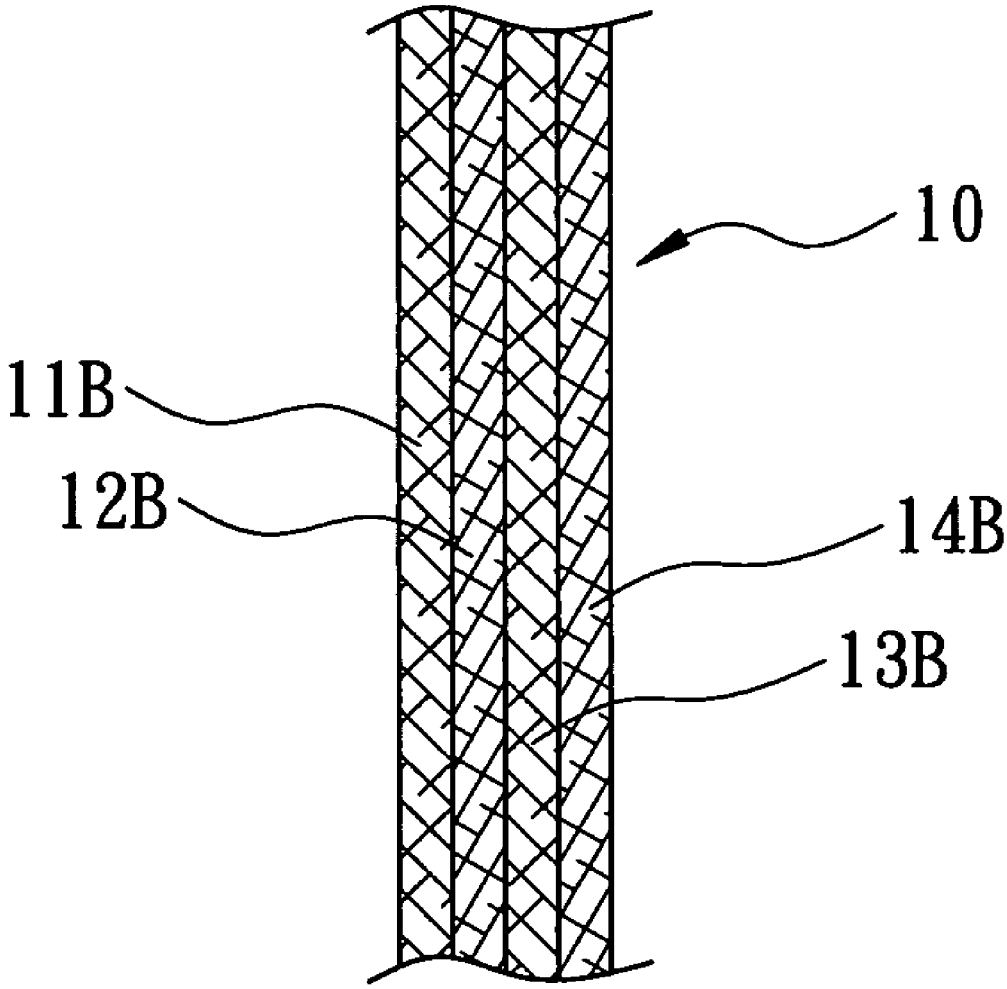
FIG. 9 is a sectional view taken along line 10—10 of FIG. 4.

Referring to FIGS. 8 and 9, a fourth preferred embodiment of the present invention is shown to include a laminated upper 10B made of a four-layered waterproof breathable laminate which is composed of an outer layer 11B, a waterproof vapor-permeable membrane 12B, a thermal insulation layer 13B, and a lining layer 14B. The upper 10B is sewn to an inner sole 20B, and the resulting seam is taped at the outer side of the seam by using a waterproof tape 27B. An outer sole 40B is then cemented to the upper 10B and the inner sole 20B. An outer sidewall 42B of the outer sole 40B covers an inner sidewall 22B of the inner sole 20B and the bottom end of the upper 10B. Since the inner sole 20B which has the same function as a sole pad is used in the present invention, the construction in the present invention is simplified and does not additionally need any functional sole pad, thus reducing the weight of the shoe. Moreover, the incorporation of the thermal insulation layer 13B into the laminate of the upper 10B saves the cost of labor and the time for manufacturing the shoe. If improved cushioning and supporting functions are desired, the inner sole 20B may be formed as a construction which has different degrees of softness and rigidity at different portions thereof.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A waterproof shoe comprising:

an upper made of a waterproof breathable laminate which includes at least one outer layer having an inner surface and an outer surface, and a waterproof vapor-permeable membrane laminated to said inner surface of said outer layer; and an inner sole which includes a bottom plate and an inner sidewall extending upwardly from a periphery of said bottom plate, said inner sidewall being connected to a bottom end of said upper, said bottom end of said upper ending at a level not lower than said bottom plate, wherein said inner sole has different degrees of softness and rigidity at different parts of said inner sole.

2. The waterproof shoe as claimed in claim 1, further comprising an outer sole disposed below said inner sole and connected at least to said inner sole.

3. The waterproof shoe as claimed in claim 2, wherein said molded body is a one-piece molded body.

4. The waterproof shoe as claimed in claim 1, wherein said outer sole has a base and an outer sidewall projecting upwardly from a periphery of said base, said outer sidewall covering said inner sidewall and surrounding at least said bottom end of said upper.

5. The waterproof shoe as claimed in claim 1, wherein said inner sole further includes an opening in said bottom plate.

6. The waterproof shoe as claimed in claim 1, wherein said inner sole includes a molded body.

7. The waterproof shoe as claimed in claim 1, wherein said inner sole includes at least two separate pieces.

8. The waterproof shoe as claimed in claim 1, wherein said inner sole is made of a thermoplastic foam.

9. The waterproof shoe as claimed in claim 1, further comprising a lining disposed inside said upper.

10. The waterproof shoe as claimed in claim 1, wherein said laminate further includes a lining layer bonded to an inner surface of said waterproof vapor-permeable membrane.

11. The waterproof shoe as claimed in claim 1, wherein said laminate further includes a thermal insulation layer bonded to an inner surface of said waterproof vapor-permeable membrane, and a lining layer bonded to an inner surface of said thermal insulation layer.

12. A waterproof shoe comprising:

an upper made of a waterproof breathable laminate which includes at least one outer layer having an inner surface and an outer surface, and a waterproof vapor-permeable membrane laminated to said inner surface of said outer layer; and an inner sole which includes a bottom plate and an inner sidewall extending upwardly from a periphery of said bottom plate, said inner sidewall being connected to a bottom end of said upper, said bottom end of said upper ending at a level not lower than said bottom plate, wherein said inner wall of said inner sole has varying thickness at different parts of said inner sole.

* * * * *